US006902443B2

(12) United States Patent
Hara et al.

(10) Patent No.: US 6,902,443 B2
(45) Date of Patent: Jun. 7, 2005

(54) CONNECTOR

(75) Inventors: Terufumi Hara, Haibara-gun (JP); Yukiyoshi Ikeda, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/803,980

(22) Filed: Mar. 19, 2004

(65) Prior Publication Data

US 2004/0190986 A1 Sep. 30, 2004

(30) Foreign Application Priority Data

Mar. 20, 2003 (JP) ..... P2003-077973

(51) Int. Cl.[7] ..... H01R 13/514
(52) U.S. Cl. ..... 439/752
(58) Field of Search ..... 439/595, 751, 439/752

(56) References Cited

U.S. PATENT DOCUMENTS 5,839,923 A * 11/1998 Yoshida ..... 439/752
5,947,775 A * 9/1999 Yamamoto et al. ..... 439/752
6,390,859 B2 * 5/2002 Furutani ..... 439/752
6,648,699 B1 * 11/2003 Makino et al. ..... 439/752
6,655,999 B2 * 12/2003 Mase et al. ..... 439/752

FOREIGN PATENT DOCUMENTS

JP 5-144499 A 6/1993

* cited by examiner

*Primary Examiner*—Thanh-Tam Le
(74) *Attorney, Agent, or Firm*—Sughrue Mion, PLLC

(57) ABSTRACT

A locking member is inserted into a cavity portion in a housing, and the side walls of the locking member are used to constitute part of the outer wall of the terminal accommodating chamber. On the inner surfaces of first locking projections respectively provided on the one-end-face sides of the present two side walls, there are projectingly provided guide ribs so as to extend in parallel to the insertion direction of a connecting terminal. When inserting the connecting terminal into the terminal accommodating chamber, even in case where the connecting terminal is inserted in an inclined manner, the connecting terminal is guided by the guide ribs and the inclination thereof is corrected by the guide ribs, whereby the connecting terminal can be inserted smoothly and the leading end of the connecting terminal is prevented from interfering with the terminal accommodating chamber, the locking member, first locking projections.

7 Claims, 12 Drawing Sheets

CONNECTOR

BACKGROUND OF THE INVENTION

The present invention relates to a connector and, in more particular, to a connector structured such that a connecting terminal stored in a terminal accommodating chamber is double locked to thereby prevent the connecting terminal from falling off from a housing.

Conventionally, there is known a connector of a type that a connecting terminal stored in a terminal accommodating chamber is double locked to thereby prevent the connecting terminal from falling off from a housing (For example, see JP-A-5-144499 (Pages 3 to 4, FIG. 3)). FIG. 11 is an exploded perspective view of the main portions of a conventional connector disclosed in JP-A-5-144499, and FIG. 12 is a longitudinal sectional perspective view of the main portions of a connector housing and a locking member used in the connector shown in FIG. 11.

As shown in FIG. 11, according to the conventional connector including a double locking mechanism, in a connector housing 2, there are formed a plurality of terminal accommodating chambers 2*b* and, lances are disposed in the terminal accommodating chambers 2*b*, respectively. These lances are engaged with the shoulder portion 4*a* of the connecting terminal 4 to thereby prevent the connecting terminal 4 from slipping out of the connector housing 2 after inserted.

In the middle portion of one outer peripheral wall 2*a* of the connector housing 2, there is formed a cavity portion 2*c* which crosses the terminal accommodating chambers 2*b* formed in the interior of the connector housing 2. A locking member (that is, a so called spacer) 3 is inserted from the cavity portion 2*c* into the connector housing 2, and terminal locking portions 3*a* formed in the locking member 3 are engaged with the locking hole 4*b* of the connecting terminal 4. Therefore, the connecting terminal 4 can be double locked by the lance and the terminal locking portion 3*a* of the locking member 3 in the interior of the connector housing 2.

In the locking member 3, there are formed a plurality of openings 3*e* in correspondence to the terminal accommodating chambers 2*b*. That is, the partition walls 2*e* of the terminal accommodating chambers 2*b* and the partition walls 3*f* of the openings 3*e* are formed so as to correspond to each other; and, when the locking member 3 is inserted into the cavity portion 2*c*, the partitions 2*e* and 3*f* are arranged continuously with each other in their connecting portions with no clearance between them.

As shown in FIG. 12, in order to realize a reduction in the size of the connector, two outer-most walls 2*d* respectively disposed on the two ends of the respective terminal accommodating chambers 2*b* are cut in the cavity portion 2*c* and its neighboring portions. In case where the locking member 3 is inserted into the cavity portion 2*c*, the inner surfaces of the outer walls 3*b* of the locking member 3 are respectively arranged so as to be substantially flush with the inner surfaces of the outer-most walls 2*d* of the terminal accommodating chambers 2*b* and, in the cavity portion 2*c*, the outer walls 3*b* of the locking member 3 operate just like the outer-most walls 2*d* of the terminal accommodating chambers 2*d* to thereby guide and hold the connecting terminal 4.

In the above-mentioned conventional connector 1, when inserting the connecting terminal 4 into the terminal accommodating chamber 2*b* from behind the connector housing 2, in some cases, the connecting terminal 4 can be inserted in such a manner that it is inclined with respect to the axis of the terminal accommodating chamber 2*b*. Normally, the connecting terminal 4 is guided sequentially by the partition walls 2*e* of the terminal accommodating chamber 2*b* and the partition wall 3*f* of the locking member 3, which are arranged continuously with each other with no clearance between them, and thus the connecting terminal 4 can be inserted into the terminal accommodating chamber 2*b* smoothly.

In the outer wall 3*b* of the locking member 3 which constitutes a portion of the outer wall of the terminal accommodating chamber 2 on the outer-most side, there is formed a locking portion 3*c* which can be engaged with the connector housing 2. Generally, in the locking portion 3*c*, as shown by a broken line in FIG. 12, in most cases, there is formed an inverted-U-shaped groove 3*d* in order to apply elasticity to the locking portion 3*c*; however, the continuity of the wall surface is lost due to the inverted-U-shaped groove 3*d* (that is, the present wall surface is turned into an uneven surface). Therefore, in case where the connecting terminal 4 is inserted into the terminal accommodating chamber 2*b* in such a manner that the leading end of the connecting terminal 4 is inclined to the outside, there is a possibility that the leading end of the connecting terminal 4 can interfere with the corner portion of the inverted-U-shaped groove 3*d*, thereby preventing the smooth insertion of the connecting terminal 4. When the interference between the locking member 3 and connecting terminal 4 is strong, the interfering portion in the leading end of the connecting terminal 4 is shaved to thereby produce shavings there, and the-thus-produced shavings can result in the poor conduction of the connector 1. Also, when the insertion resistance of the connecting terminal 4 increases extremely, an automatic terminal inserting apparatus (not shown) can be caused to stop, which provides a factor in impairing the productivity of the connector.

SUMMARY OF THE INVENTION

The present invention aims at eliminating the drawbacks found in the above-mentioned conventional connector. Accordingly, it is an object of the invention to provide a connector structured such that the outer walls of two terminal accommodating chambers disposed in the two inner ends of a locking member inserting cavity formed in a connector housing are composed of the outer walls of a locking member, in which, even when a connecting terminal is inserted into the terminal accommodating chamber in such a manner that it is inclined, the connecting terminal can be inserted smoothly without interfering with the outer walls of the terminal accommodating chamber and locking member.

In order to solve the aforesaid object, the invention is characterized by having the following arrangement.

(1) A connector comprising:

a housing;

front and rear terminal accommodating chambers for accommodating a connecting terminal in a terminal inserting direction defined by an outer peripheral wall of the housing;

a cavity portion formed between the front and rear terminal accommodating chambers;

a locking member adapted to be inserted into the cavity portion in a locking member inserting direction and held in a provisionally locking position and in a regularly locking position;

an opening formed through the locking member, which corresponds to the front and rear terminal accommodating chambers;

a terminal locking portion engageable with the connecting terminal formed at the opening;

a side wall formed parallel to the inserting direction and defining an inner side surface of the opening;

a first locking projection for a provisional lock formed at the side wall;

a guide rib formed in parallel to the terminal inserting direction at an inside surface of the first locking projection so that the guide rib are projected inwardly with respect to an inner side wall of the terminal accommodating chamber when the locking member is held in the provisionally locking position;

a second locking projection for a regularly lock formed at the side wall;

a first locking portion formed at the housing, which is engaged with the first locking projection in the provisionally locking position so that the connecting terminal can be inserted in the front and rear terminal accommodating chambers and the opening; and a second locking portion formed at the housing, which is engaged with the second locking projection in the regularly locking position so that the terminal locking portion is engaged with the connecting terminal.

(2) The connector according to (1), wherein the connector is formed so that the connecting terminal is inserted from the front terminal accommodating chamber through the opening to the rear terminal accommodating chamber.

(3) The connector according to (2), wherein the first locking projection is formed at a rear side of the side wall and the second locking projection is formed at a front side of the side wall.

(4) The connector according to (2), wherein the guide rib includes a taper surface at a front end thereof.

(5) The connector according to (2), wherein the second locking projection includes a taper surface at a front end thereof.

(6) The connector according to (1), wherein a plurality of the front and rear terminal accommodating chambers are arranged side by side, and a plurality of the openings are arranged side by side so as to correspond to the plurality of front and rear terminal accommodating chambers.

(7) The connector according to (1), wherein the first and second locking projections are offset from each other in the locking member inserting direction.

DETAILED DESCRIPTION OF PREFERRED EMBODIMENTS

Figure 1:
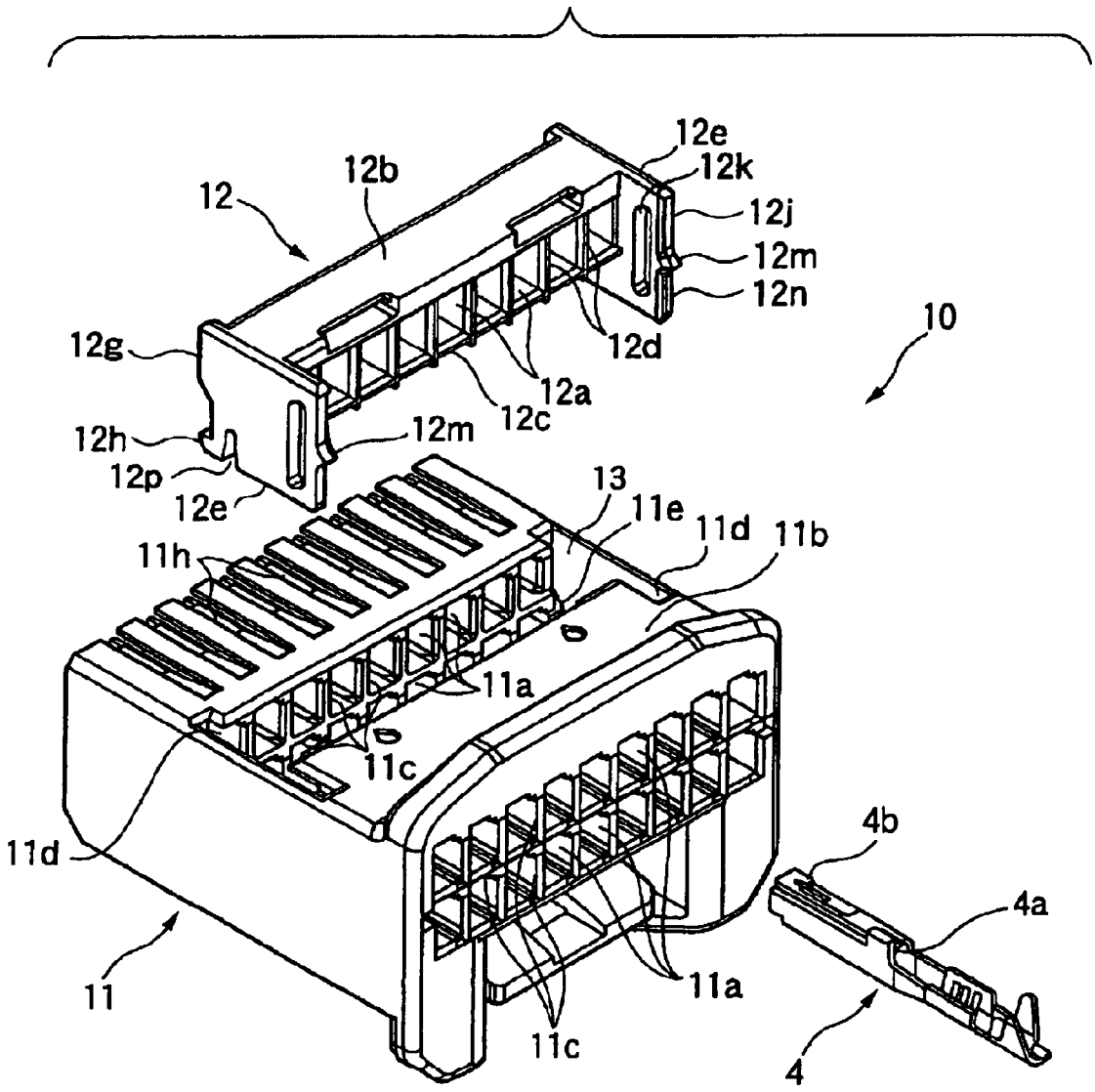
FIG. 1 is an exploded perspective view of a connector according to an embodiment of the invention including a housing, a locking member and a connecting terminal.
Figure 2:
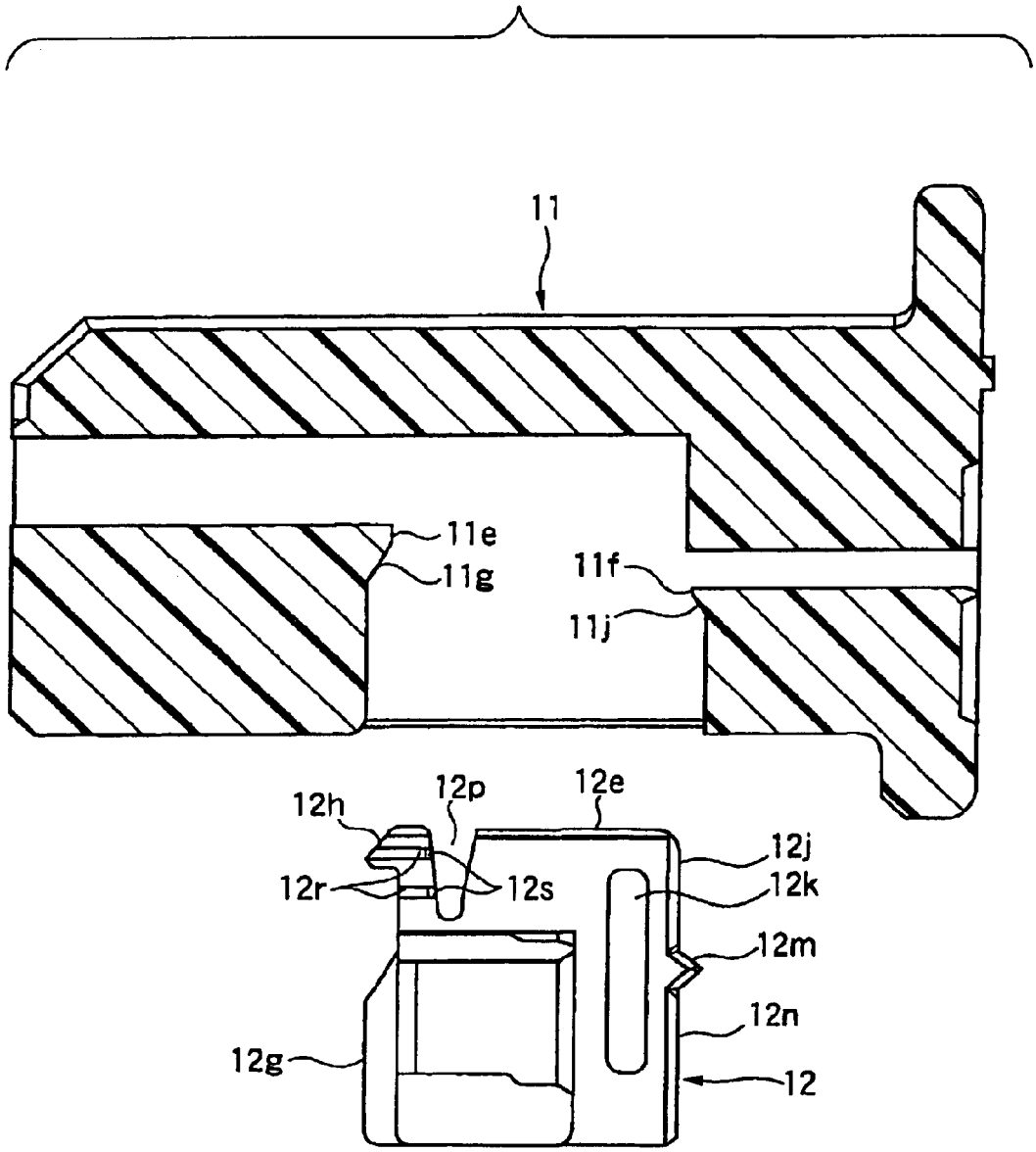
FIG. 2 is an enlarged perspective view of the main portions of the connector, showing the shapes of the outer wall of the outer-most terminal accommodating chamber of the housing and the side wall of the locking member.
Figure 3:
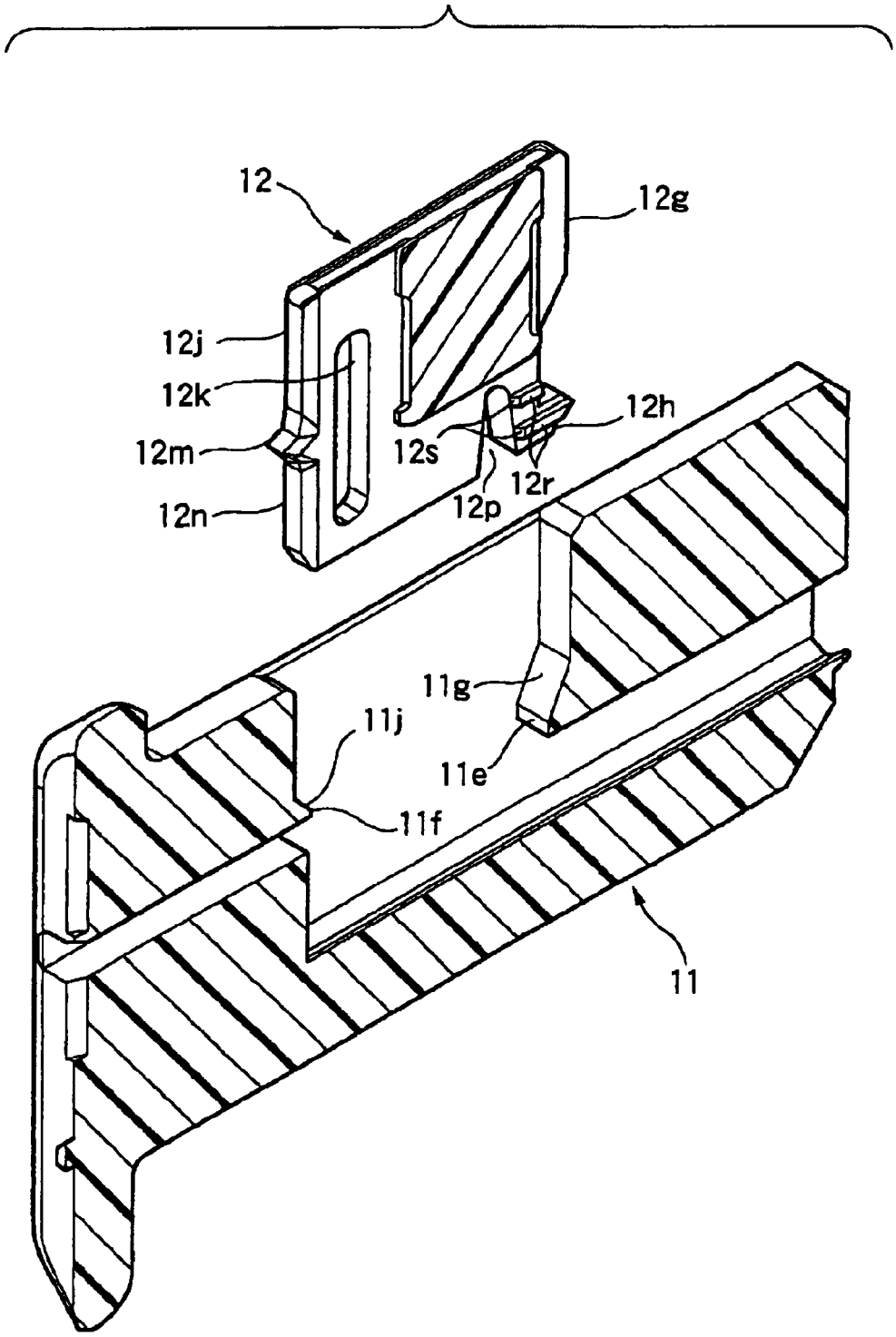
FIG. 3 is an enlarged longitudinal section view of the main portions of the connector, showing the shapes of the outer wall of the outer-most terminal accommodating chamber of the housing and the side wall of the locking member.
Figure 4:
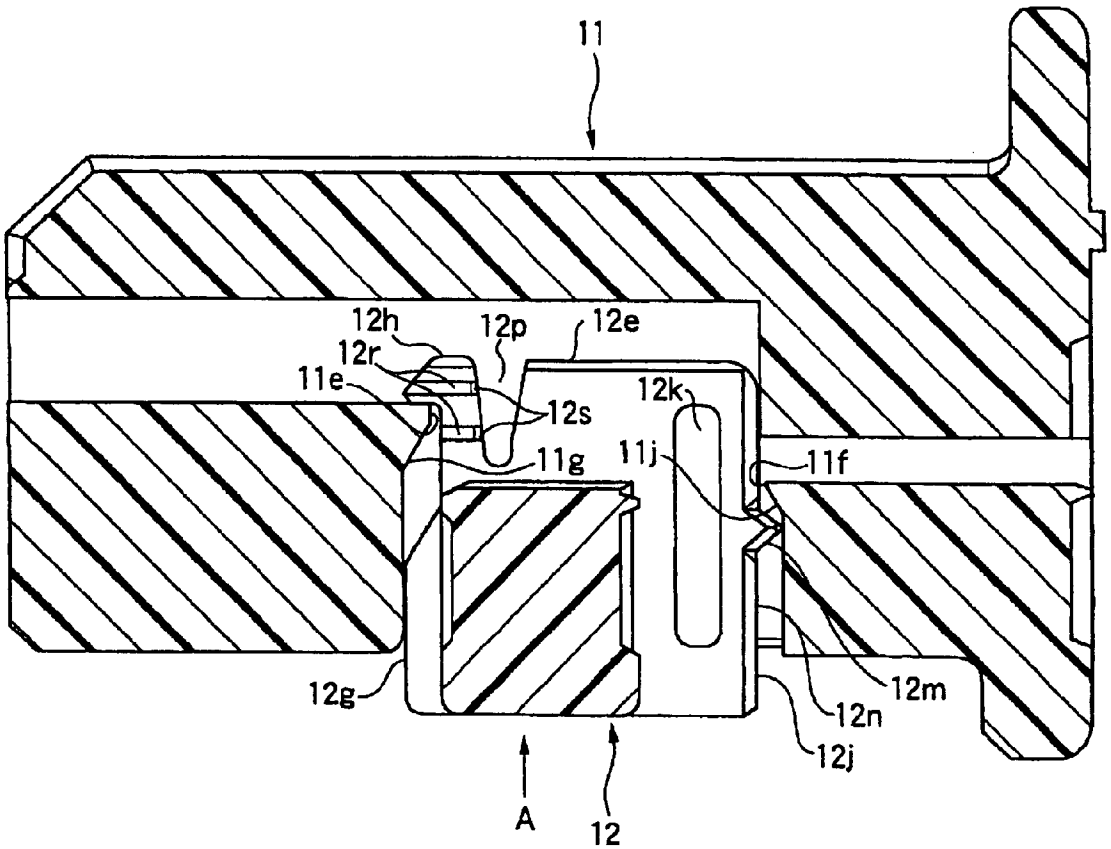
FIG. 4 is an enlarged longitudinal section view of the main portions of the connector, showing a state in which the locking member is provisionally locked to the housing.
Figure 5:
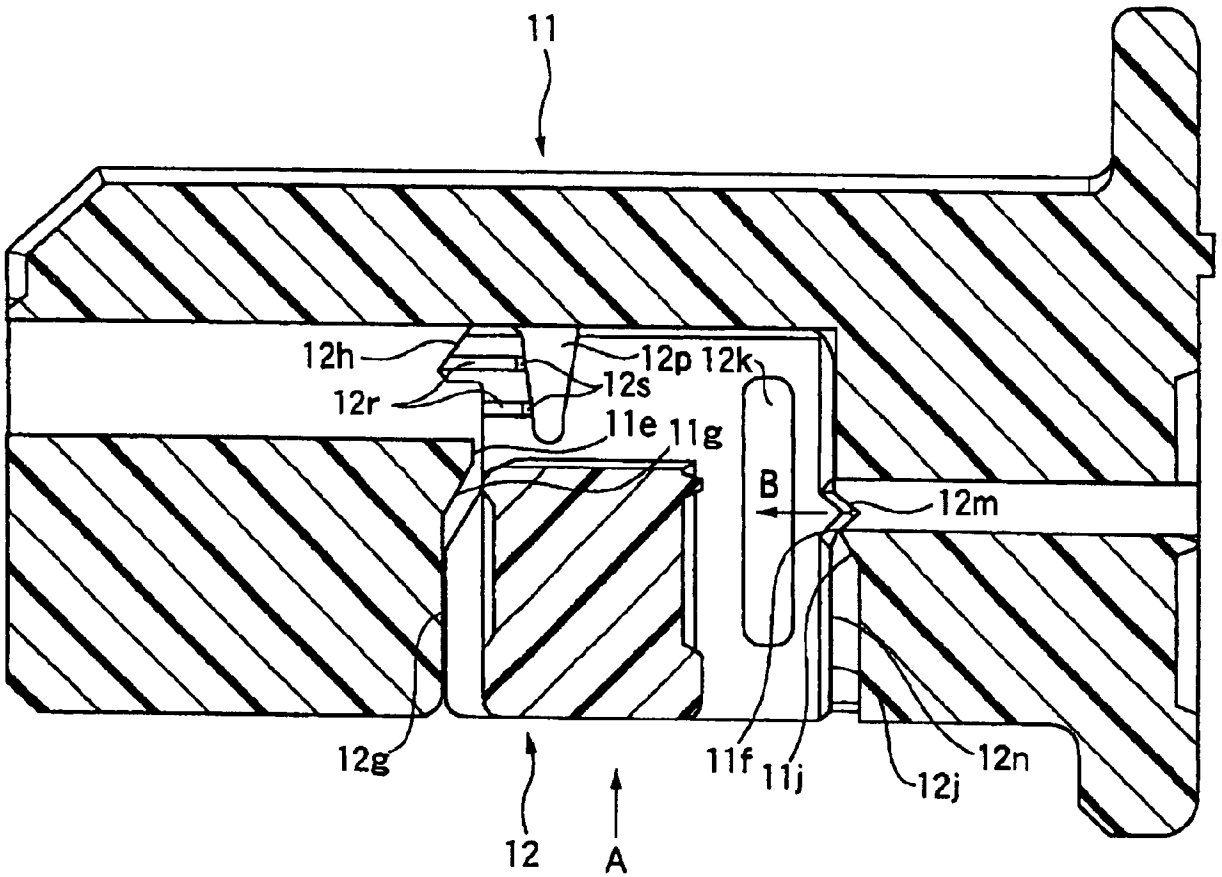
FIG. 5 is an enlarged longitudinal section view of the main portions of the connector, showing a state in which the locking member is regularly locked to the housing.
Figure 6:
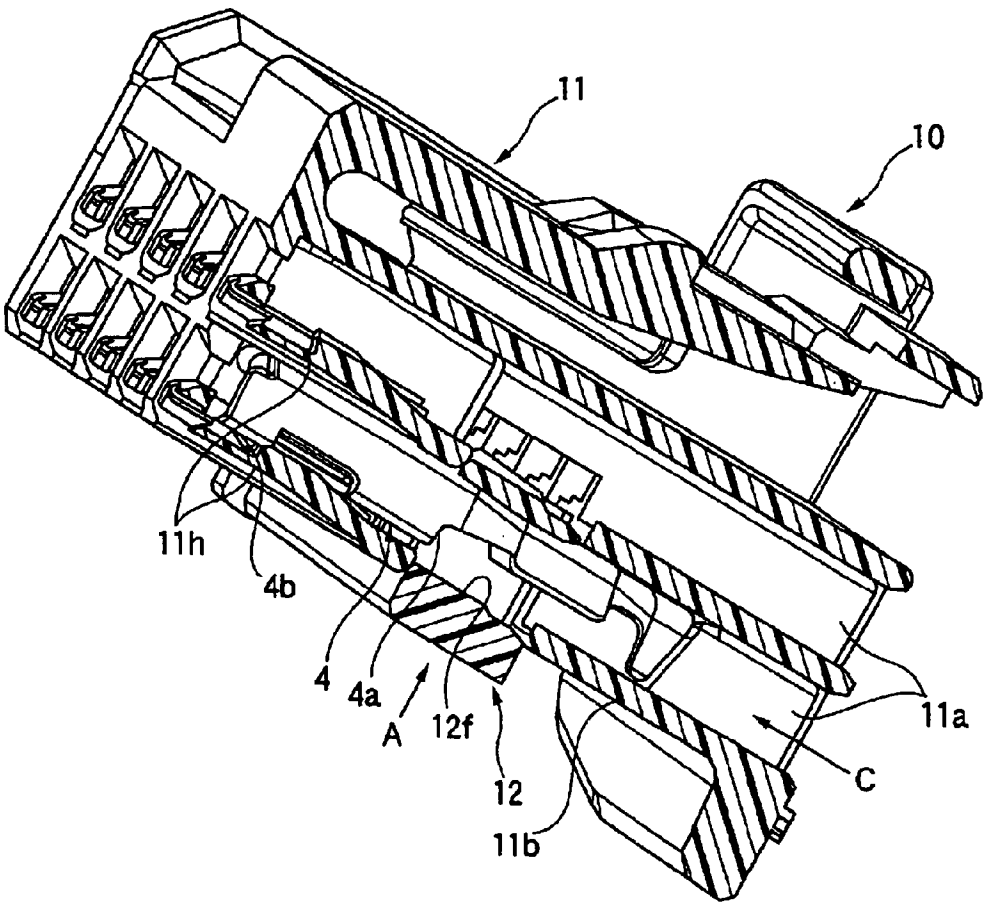
FIG. 6 is a perspective section view of the main portions of the connector, showing a state in which the connecting terminal is inserted into the housing with the locking member provisionally locked thereto.
Figure 7:
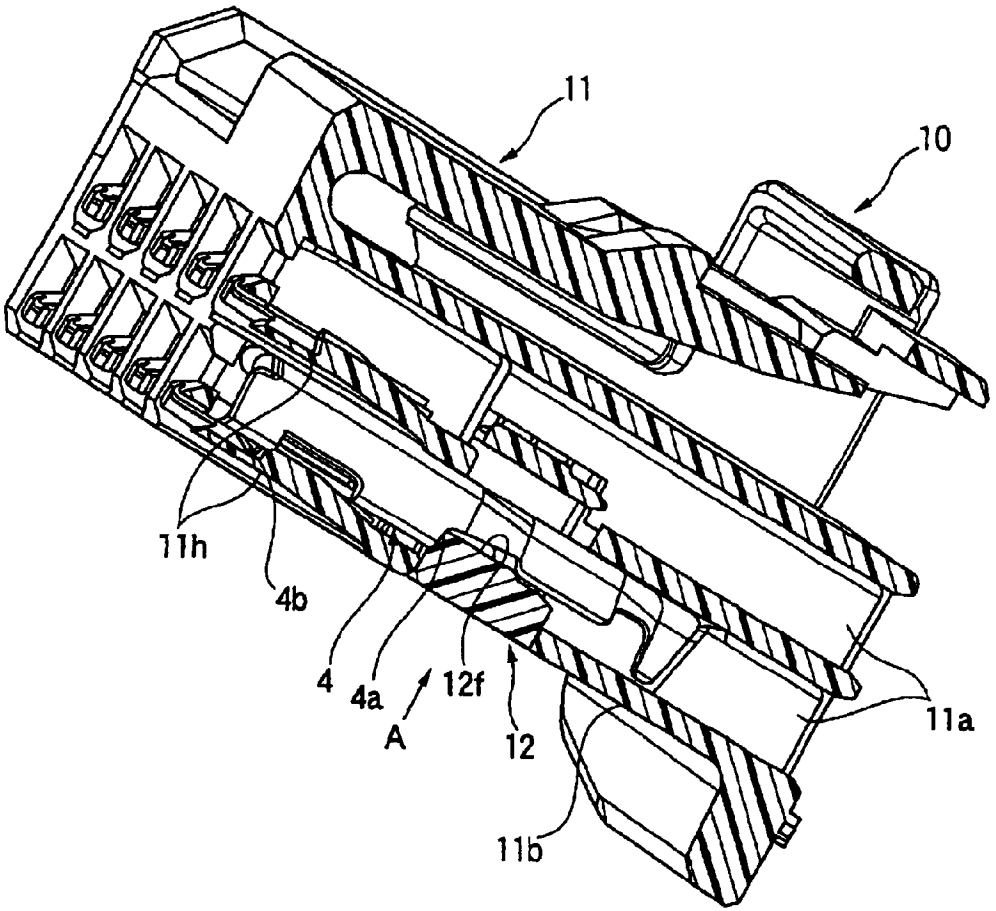
FIG. 7 is a perspective section view of the main portions of the connector, showing a state in which the locking member is regularly locked to the housing with the connecting terminal inserted thereinto.
Figure 8:
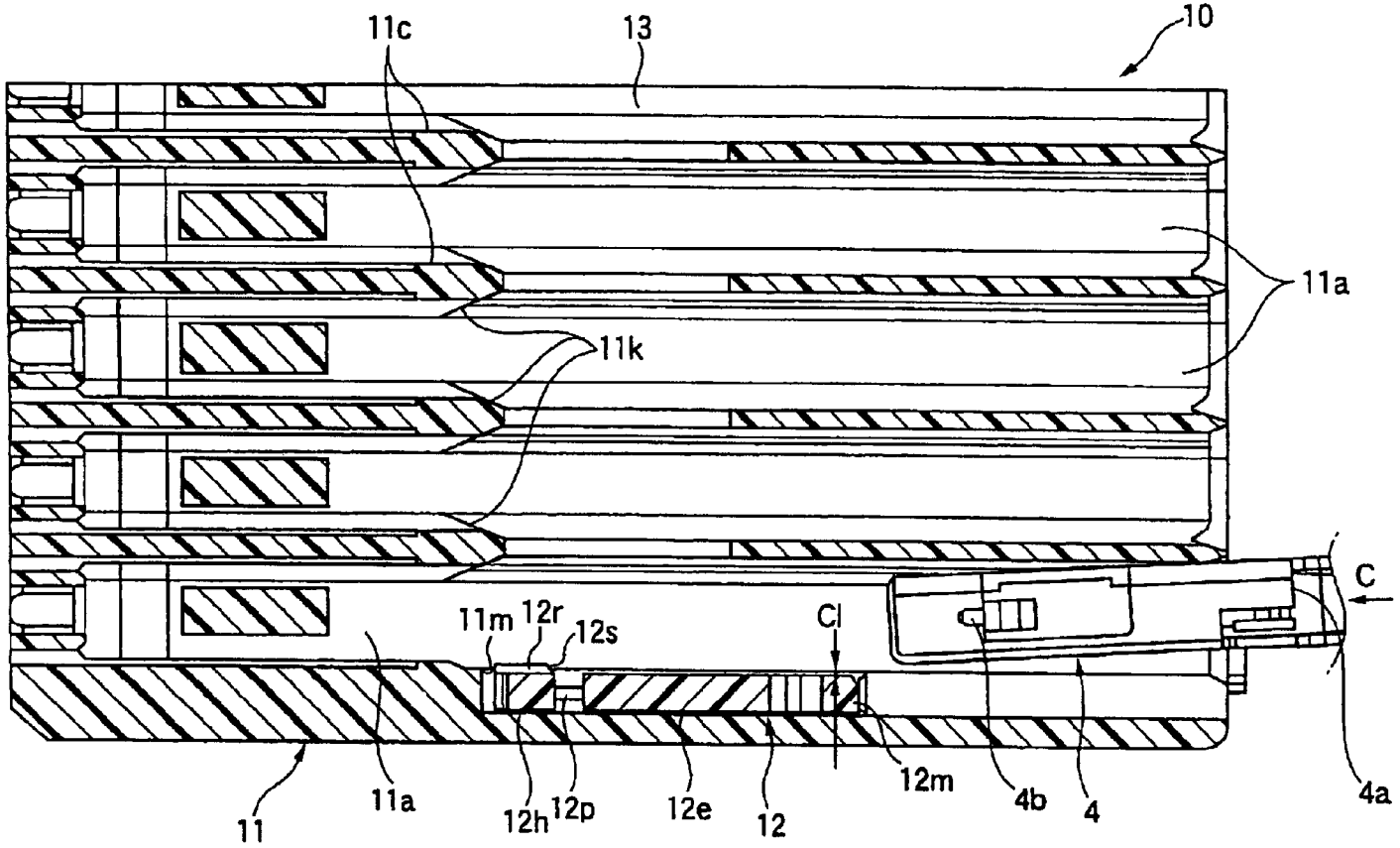
FIG. 8 is a transverse section view of the main portions of the connector, showing a state in which the insertion of the connecting terminal into the outer-most terminal accommodating chamber of the housing with the locking member provisionally locked thereto is started.
Figure 9:
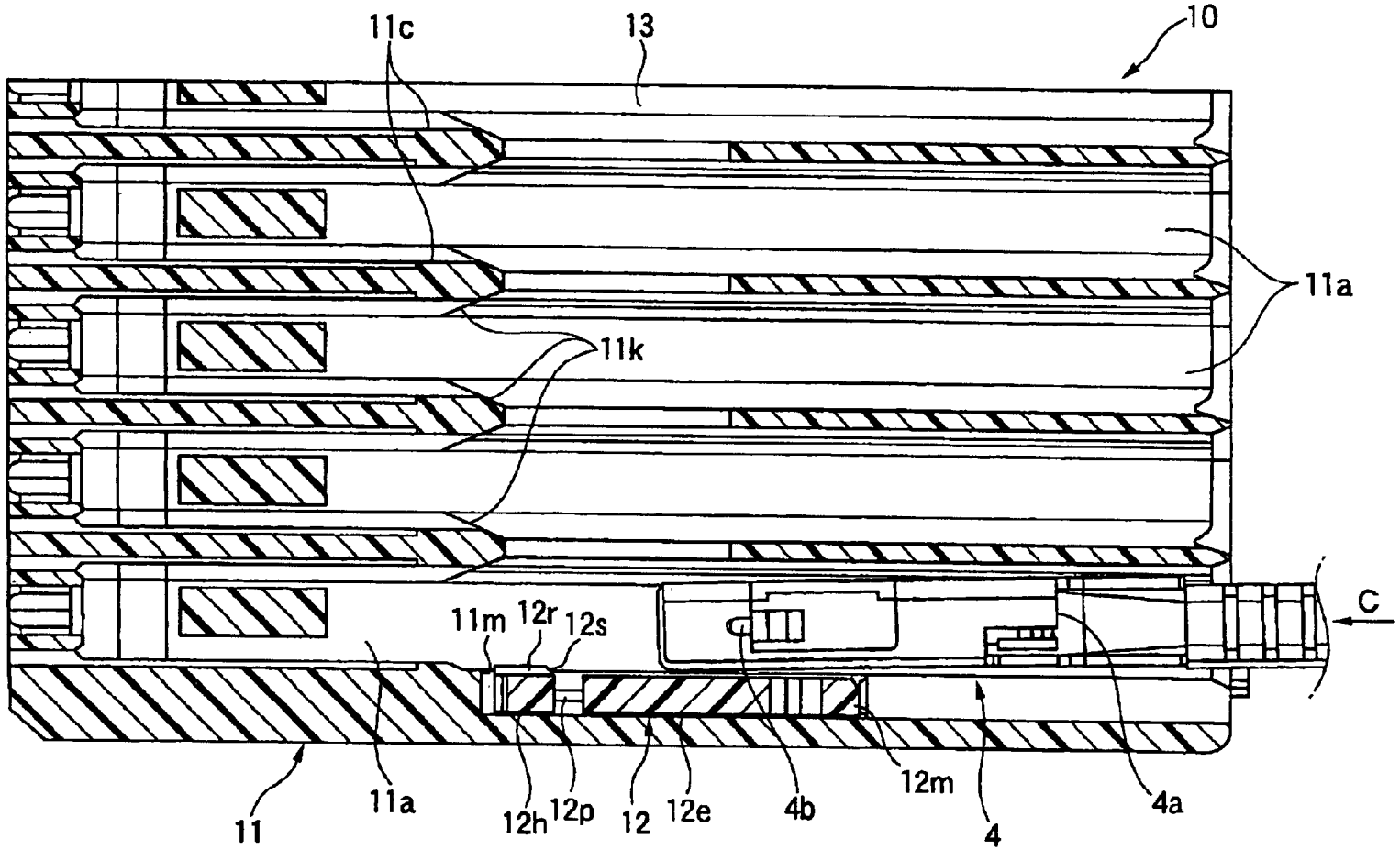
FIG. 9 is a transverse section view of the main portions of the connector, showing a state in which the leading end of the connecting terminal inclinedly inserted into the terminal accommodating chamber is contacted with the inner surface of the locking member.
Figure 10:
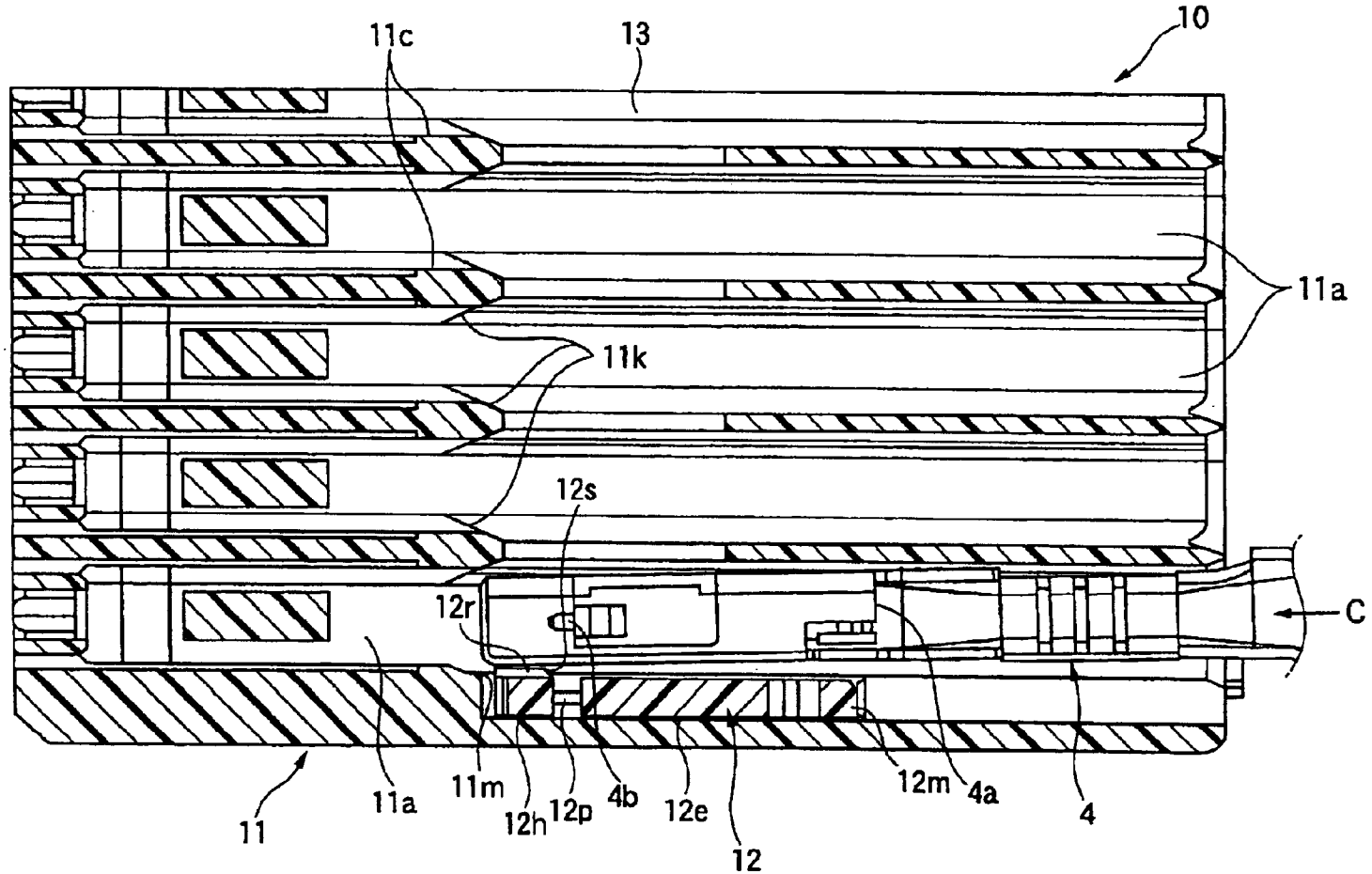
FIG. 10 is a transverse section view of the main portions of the connector, showing a state in which the connecting terminal is inserted into the terminal accommodating chamber while it is guided by a guide rib and the inclination thereof is corrected by guide ribs.
Figure 11:
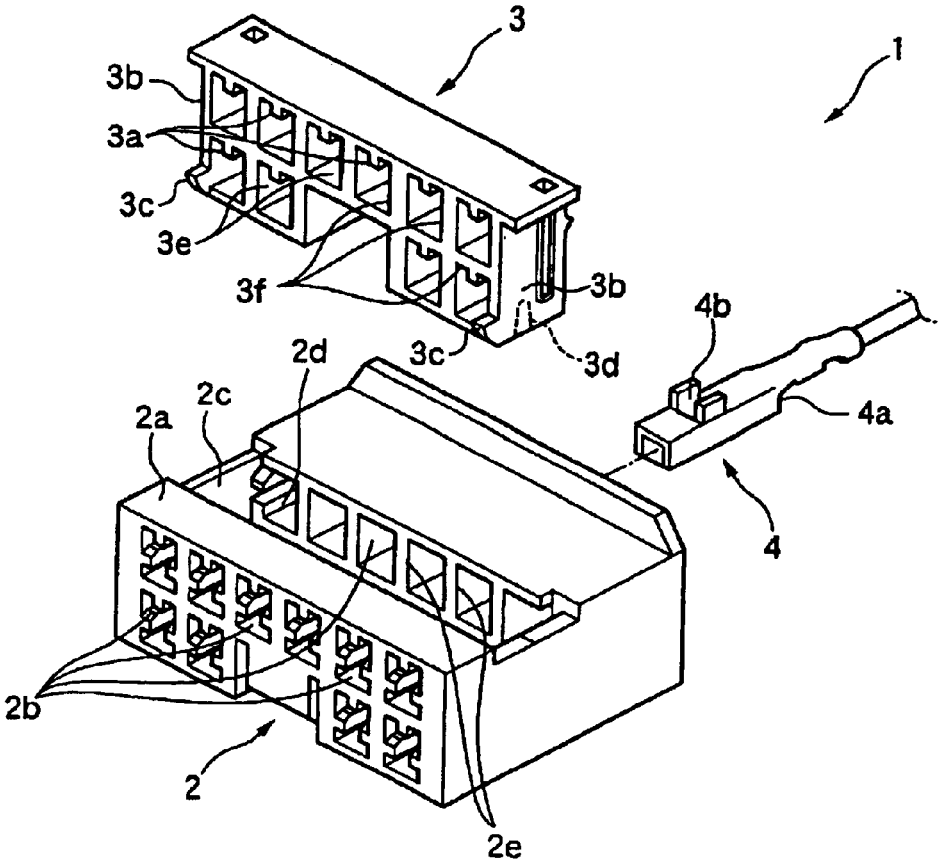
FIG. 11 PRIOR ART
FIG. 11 is an exploded perspective view of a conventional connector.
Figure 12:
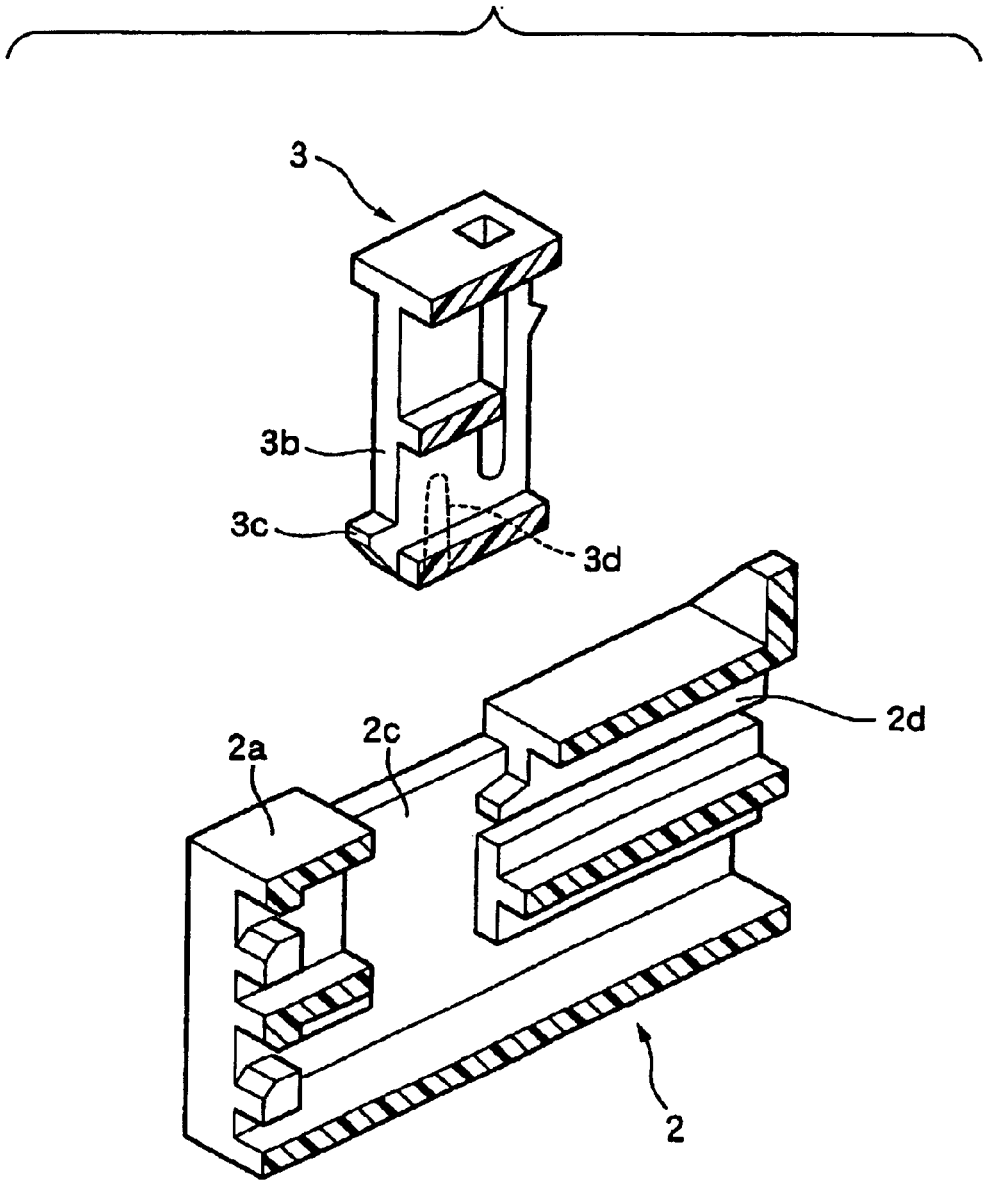
FIG. 12 PRIOR ART
FIG. 12 is a longitudinal perspective section view of the main portions the connector housing and locking member of the connector shown in FIG. 11.

Now, description will be given below in detail of a connector of a preferred embodiment according to the invention with reference to the accompanying drawings. FIG. 1 is an exploded perspective view of a connector according to the preferred embodiment of the invention comprising a housing, a locking member and a connecting terminal; FIG. 2 is an enlarged longitudinal section view of the main portions of the connector, showing the shapes of the outer walls of the outer-most terminal accommodating chambers formed in the housing and the shapes of the side walls of the locking member; FIG. 3 is an enlarged perspective section view of the main portions of the connector, showing the shapes of the outer walls of the outer-most terminal accommodating chambers formed in the housing and the shapes of the side walls of the locking member; FIG. 4 is an enlarged longitudinal section view of the main portions of the connector, showing a state thereof in which the locking member is provisionally locked to the housing; FIG. 5 is an enlarged longitudinal section view of the main portions of the connector, showing a state thereof in which the locking member is regularly locked to the housing; FIG. 6 is a perspective section view of the connector, showing a state in which the connecting terminal is inserted into the housing with the locking member provisionally locked thereto; FIG. 7 is a perspective section view of the connector, showing a state in which the connecting terminal is inserted into the housing with the locking member regularly locked thereto; FIG. 8 is a transverse section view of the connector, showing a state in which the insertion of the connecting terminal into the outer-most terminal accommodating chamber of the housing with the locking member provisionally locked thereto; FIG. 9 is a transverse section view of the connector, showing a state in which the leading end of the connecting terminal inclinedly inserted into the terminal accommodating chamber is contacted with the side surface of the locking member; and, FIG. 10 is a transverse section view of the connector, showing a state in which the connecting terminal is inserted while it is guided by the guide rib and the inclination thereof is corrected by the guide rib.

As shown in FIG. 1, a connector 10 according to an embodiment of the invention includes a male-type housing 11 composed of a synthetic-resin-made insulator, a locking member 12 composed of a synthetic-resin-made insulator, and a connecting terminal 4. By the way, in FIG. 1, the connector 10 is shown in such a manner that the upper portion of the housing 11 faces downward and the lower portion thereof faces upward. In the interior of the housing 11, there are formed a plurality of terminal accommodating chambers 11*a* in two upper and lower stages, while they are spaced from each other by their respective partition walls 11*c*. In the middle portion of the lower portion outer peripheral wall 11*b* of the housing 11, there is formed a cavity portion 13 which penetrates vertically therethrough while crossing the partition walls 11*c* existing between the terminal accommodating chambers 11*a*; and, the locking member 12 can be removably inserted into the housing 11 from this cavity portion 13. The outer walls of the terminal accommodating chambers 11*a*, which are respectively disposed on the outer-most sides, are cut away in the cavity portion 13 and its neighboring portion, thereby providing groove portions 11*d* respectively. In the interiors of the terminal accommodating chambers 11*a* that are formed in front of the cavity portion 13, there are provided lances 11*h* which can be engaged with the engaging projection 4*b* of the connecting terminal 4, while each of the lances 11*h* is structured such that it projects inwardly of the terminal accommodating chamber 11*a* with the front and rear end portions thereof supported on the interior of the terminal accommodating chamber 11*a*.

The locking member 12 is a frame body including a plurality of openings 12*a* each having an opening dimension substantially equal to the opening dimension of each of the plurality of terminal accommodating chambers 11*a*. The locking member 12 further includes a cover plate portion 12*b* for covering the cavity portion 13, a bottom plate portion 12*c* formed in parallel to the cover plate portion 12*b*, vertical plate portions 12*d* respectively interposed between the openings 12*a* so as to correspond to the partition walls 11*c* of the terminal accommodating chambers 11*a*, and the two right and left side walls 12*e* that are the outer-most vertical plate portions. In the interior of each opening 12*a*, there is projectingly provided a terminal locking portion 12*f* (see FIG. 6) which can be engaged with the shoulder portion 4*a* of the connecting member 4. On the lower end of the front end face 12*g* of each side wall 12, there is provided a first locking projection 12*h*; and, on the rear end face 12*j* of each side wall 12*e*, there is provided a two-end-held-beam-shaped flexible arm 12*n* having a second locking projection 12*m* through a slit 12*k*.

As shown in FIG. 2, in the rear portion of the first locking projection 12*h*, there is formed a U-shaped groove 12*p*; and, this U-shaped groove 12*p* applies elasticity to the first locking projection 12*h*. On the inner surface side of the first locking projection 12*h*, there are disposed two guide ribs 12*r* so as to extend in parallel to the insertion direction of the connecting terminal 4. In the rear end portions of the guide ribs 12*r*, there are formed taper surfaces 12*s* respectively. Each guide rib 12*r* has a height of, for example, about 0.15 mm. When the locking member 12 is inserted into the cavity 13, the guide rib 12*r* can be projected slightly from the partition wall 11*c* of the terminal accommodating chamber 11*a*. The first locking projection 12*h* has a taper surface on the upper surface side thereof. On the other hand, the second locking projection 12*m* is formed as an angular projection the upper and lower surfaces of which are taper surfaces.

As shown in FIGS. 2 and 3, in correspondence to the first and second locking projections 12*h* and 12*m* of the locking member 12, a first engaging portion 11*e* and a second engaging portion 11*f* are formed in the interior of the housing 11. The first engaging portion 11*e* is formed so as to be engaged with the first locking projection 12*h* and provisionally locked at a provisionally locking position when the locking member 12 is inserted from the cavity portion 13 into the housing 11 and reaches such a position where the openings 12*a* of the locking member 12 are substantially matched to the respective terminal accommodating chambers 11*a*. The first engaging portion 11*e* has a taper surface 11*g* on the lower surface side thereof. On the other hand, the second engaging portion 11*f* is formed so as to be engaged with the second locking projection 12*m* and regularly locked at a regularly locking position when the locking member 12 is inserted further and the terminal locking portion 12*f* is engaged with the shoulder portion 4*a* of the terminal locking portion 12*f*. The second engaging portion 11*f* has a taper surface 11*j* on the lower surface side thereof.

As shown in FIG. 4, in case where the locking member 12 is inserted into the cavity portion 13 of the housing 11 and is then pushed lightly in the arrow mark A direction, the first locking projection 12*h* climbs over the first engaging portion 11*e* of the housing while allowing its taper surface to be slidingly contacted with the taper surface 11*g*, at the same time, the second locking projection 12*m* runs up onto the taper surface 11*j* of the second engaging portion 11*f*, whereby the locking member 12 can be provisionally locked to the housing 11. At this provisionally locked position, the openings 12*a* of the locking member 12 are substantially matched to the terminal accommodating chambers 11*a* so that the connecting terminal 4 can be inserted into the housing 11 from behind the housing 11 (that is, they are in communication with each other to such a degree that the connecting terminal 4 can be inserted).

As shown in FIG. 5, in case where the locking member 12 is pushed in the arrow mark A direction still further from the above-mentioned provisionally locked position, the flexible arm 12*n* with elasticity applied from the slit 12*k* is flexed in the arrow mark B direction; and, due to this, the second locking projection 12*m* climbs over the second engaging portion 11*f* while allowing its tape surface to be slidingly contacted with the taper surface 11*j*, so that the locking member 12 can be locked to the housing 11 regularly. At this regularly locked position, as shown in FIG. 7, the terminal locking portion 12*f* is engaged with the shoulder portion 4*a* of the connecting terminal 4. Therefore, the connecting terminal 4 can be double locked by the terminal locking portion 12*f* and lance 11*h*.

That is, at the provisionally locked position shown in FIG. 4, as shown in FIG. 6, in case where the connecting terminal 4 is inserted into the terminal accommodating chamber 11*a* in the arrow mark C direction, the lance 11*h* of the terminal accommodating chamber 11*a* is engaged with the engaging projection 4*b* of the connecting terminal 4 to thereby lock the connecting terminal 4 primarily. In this state, as shown in FIG. 7, when the locking member 12 is pushed in the arrow mark A direction and is thereby moved to the regularly locking position, the terminal locking portion 12*f* of the opening 12*a* is engaged with the shoulder portion 4*a* of the connecting terminal 4, so that the connecting terminal 4 can be further locked secondarily. By the way, to remove the locked state of the locking member 12, the above-mentioned procedures may be reversed.

Next, description will be given below of the operation of the present embodiment of the invention.

As shown in FIG. 4, in case where the locking member 12 is inserted into the cavity portion 13 of the housing 11 and is then pushed in the arrow mark A direction, the first locking projection 12*h* climbs over the first engaging portion 11*e* of the housing 11 and, at the same time, the second locking projection 12*m* goes up onto the second engaging portion 11*f*, so that the locking member 12 is locked provisionally. In this provisionally locked position, the openings 12*a* of the locking member 12 are substantially matched to the terminal accommodating portions 11*a* respectively.

As shown in FIG. 6, with the locking member 12 locked provisionally, the connecting terminal 4 is inserted in the arrow mark C direction into the housing 11 from back. The connecting terminal 4, which has been inserted into the terminal accommodating chamber 11*a*, advances while pressing down the lance 11*h* and the lance 11*h* is then engaged with the engaging projection 4*b* to thereby lock the connecting terminal 4 primarily.

As shown in FIG. 8, in a state where the locking member 12 is provisionally locked to the housing 11, the partition walls 11*c* of the terminal accommodating chambers 11*a* are disposed continuously with the bottom plate portions 12*c* and vertical plate portions 12*d* which are the partition walls of the openings 12*a*, in such a manner that no clearances are present between them. Taper surfaces 11*k* are formed in the corner portions of the partition walls 11*c* that are situated forwardly of the cavity portion 13. Thanks to this, the connecting terminal 4 can be inserted into the terminal accommodating chamber 11*a* smoothly without interfering with any portion of the terminal accommodating chamber 11*a*.

The outer walls of the two outer-most terminal accommodating chambers 11*a* are respectively cut away in the cavity portion 13 and thus the side walls 12*e* of the locking member 12 inserted into the groove portion 11*d* operate substantially as the outer walls. In other words, the outer wall of each outer-most terminal accommodating chamber 11*a* is composed of a combination of the two different parts, namely, the housing 11 and the side wall 12*e* of the locking member 12.

By the way, as shown in FIG. 8, in order to be able to prevent the leading end of the connecting terminal 4 from interfering with the rear end corner portion of the side wall 12*e* even when the connecting terminal 4 is inserted while it is inclined with respect to the axis of the terminal accommodating chamber 11*a*, preferably, the thickness of the side wall 12*e* may be set small so as to stand off the outer wall of the outer-most terminal accommodating chamber 11*a*, thereby forming a level difference c1 between the outer wall of the terminal accommodating chamber 11*a* and the side wall 12*e* of the locking member 12.

As shown in FIGS. 9 and 10, in case where the connecting terminal 4 is inserted further in the arrow mark C direction and the leading end of the connecting terminal 4 reaches the U-shaped groove 12*p* of the locking member 12, the leading end portion of the connecting terminal 4 is guided by the taper surface 12*s* and guide rib 12*r* of the locking member 12 to thereby correct the inclination the locking member 12, so that the connecting terminal 4 can be inserted into the terminal accommodating chamber 11*a* properly with no interference with the side wall 12*e* (further, in the present embodiment, the corner portion 11*m* of the front-end-side outer wall of the cavity portion 13).

In this manner, by providing the guide rib 12*r* on the inner surface of the first locking projection 12*h* of the locking member 12 so as to extend in parallel to the insertion direction of the connecting terminal 4, even in case where the connecting terminal 4 is inserted inclined with respect to the axis of the terminal accommodating chamber 11*a*, the inclination of the connecting terminal 4 can be corrected by the taper surface 12*s* and guide rib 12*r*, so that the connecting terminal 4 can be inserted properly without interfering with the inner wall of the terminal accommodating chamber 11*a*.

As shown in FIGS. 5 and 7, after the connecting terminal 4 is inserted and the lance 11*h* is engaged with the engaging projection 4*b* of the connecting terminal 4, in case where the locking member 12 is pushed in the arrow mark A direction further from the provisionally locked position, the second locking projection 12*m* climbs over the second engaging portion 11*f* and the locking member 12 is thereby locked regularly. At the then time, since the terminal locking portion 12*f* is engaged with the shoulder portion 4*a* of the connecting terminal 4, the connecting terminal 4 is double locked by the lance 11*h* and terminal locking portion 12*f*.

By the way, the invention is not limited to the above-described embodiment but various proper changes and modifications are also possible. The materials, shapes, dimensions, numbers, mounting positions and the like of the respective components of the above-described embodiment are not limitative but they can be selected arbitrarily, provided that they are capable of attaining the object of the invention.

By the way, in the case of the above-described embodiment, description has been given of a case in which the locking member is applied to the male-type connector housing storing the female terminal (connecting terminal) therein. However, the locking member can also be applied similarly to a female-type connector housing storing a male terminal therein.

As has been described heretofore, according the connector of the invention, the locking member is inserted into the cavity portion formed in the housing and the two side walls of the locking member are used to constitute part of the outer walls of the outer-most terminal accommodating chamber. Also, in the inner surfaces of the first locking projections provided on the one-end-face sides of the above two side walls, there are disposed guide ribs so as to extend in parallel to the insertion direction of the connecting terminal. Thanks to this, when inserting the connecting terminal into the terminal accommodating chamber, even in case where the connecting terminal is inserted in an inclined state, and thus the inclination of the connecting terminal can be corrected by the guide ribs while the connecting terminal is being guided by the guide ribs, so that the leading end of the connecting terminal can be prevented from interfering directly with the outer wall of the locking member. Also, this can prevent the housing and locking member from being shaved by the leading end of the connecting terminal, thereby being able to perfectly prevent the occurrence of the poor conduction of the connector by the shavings. Further, an increase in the insertion resistance of the connecting terminal can be prevented to thereby be able to enhance the rate of operation of an automatic terminal inserting machine.

Also, according to the connector of the invention, since the taper surface is formed in rear end portion of the guide rib disposed on the inner surface of the first engaging projection in the connecting terminal insertion direction, when the connecting terminal is inserted into the terminal accommodating chamber, even in case where it is inserted inclined with respect to the terminal accommodating chamber, the connecting terminal is guided by the taper surface and thus the inclination of the connecting terminal is corrected by the taper surface, which makes it possible to insert the connecting terminal into the terminal accommodating chamber smoothly. Also, even in case where the inner surface of the first locking projection is projected inwardly of the outer wall of the terminal accommodating chamber due to the manufacturing errors or the like of the connector parts, the connecting terminal can be inserted into the terminal accommodating chamber easily without interfering with the first locking projection.

What is claimed is:

1. A connector comprising:

a housing;

front and rear terminal accommodating chambers for accommodating a connecting terminal in a terminal inserting direction defined by an outer peripheral wall of the housing;

a cavity portion formed between the front and rear terminal accommodating chambers;

a locking member adapted to be inserted into the cavity portion in a locking member inserting direction and held in a provisionally locking position and in a regularly locking position;

an opening formed through the locking member, the opening corresponding to the front and rear terminal accommodating chambers;

a terminal locking portion engageable with the connecting terminal formed at the opening;

a side wall formed parallel to the locking member inserting direction and defining an inner side surface of the opening;

a first locking projection for a provisional lock formed at the side wall;

a guide rib formed in parallel to the terminal inserting direction at an inside surface of the first locking projection so that the guide rib are projected inwardly with respect to an inner side wall of the terminal accommodating chamber when the locking member is held in the provisionally locking position;

a second locking projection for a regularly lock formed at the side wall;

a first locking portion formed at the housing, the first locking portion being engaged with the first locking projection in the provisionally locking position so that the connecting terminal can be inserted in the front and rear terminal accommodating chambers and the opening; and a second locking portion formed at the housing, the second locking potion being engaged with the second locking projection in the regularly locking position so that the terminal locking portion is engaged with the connecting terminal.

2. The connector according to claim 1, wherein the connector is formed so that the connecting terminal is inserted from the front terminal accommodating chamber through the opening to the rear terminal accommodating chamber.

3. The connector according to claim 2, wherein the first locking projection is formed at a rear side of the side wall and the second locking projection is formed at a front side of the side wall.

4. The connector according to claim 2, wherein the guide rib includes a taper surface at a front end thereof.

5. The connector according to claim 2, wherein the second locking projection includes a taper surface at a front end thereof.

6. The connector according to claim 1, wherein a plurality of the front and rear terminal accommodating chambers are arranged side by side, and a plurality of the openings are arranged side by side so as to correspond to the plurality of front and rear terminal accommodating chambers.

7. The connector according to claim 1, wherein the first and second locking projections are offset from each other in the locking member inserting direction.

* * * * *